US007547045B2

(12) United States Patent
Fischer et al.

(10) Patent No.: US 7,547,045 B2
(45) Date of Patent: Jun. 16, 2009

(54) METHOD FOR THE PRODUCTION OF A MULTI-LAYER IDENTITY CARD OF PLASTIC

(75) Inventors: Dirk Fischer, Paderborn (DE); Ralf Henn, Hardert (DE)

(73) Assignees: Orga Kartensysteme GmbH (DE); Lohmann GmbH & Co. KG (DE)

( * ) Notice: Subject to any disclaimer, the term of this patent is extended or adjusted under 35 U.S.C. 154(b) by 0 days.

(21) Appl. No.: 10/685,367

(22) Filed: Oct. 13, 2003

(65) Prior Publication Data

US 2004/0075271 A1 Apr. 22, 2004

(51) Int. Cl.
*B42D 15/00* (2006.01)
*B42D 17/00* (2006.01)

(52) U.S. Cl. ..... 283/67; 283/107

(58) Field of Classification Search ..... 283/101, 283/105, 107, 109, 81, 103, 67, 70
See application file for complete search history.

(56) References Cited

U.S. PATENT DOCUMENTS 1,603,378 A * 10/1926 Conley ..... 246/456
3,729,334 A * 4/1973 Snelling ..... 430/102
4,419,436 A * 12/1983 Kranser ..... 430/260
4,437,893 A * 3/1984 Krinski et al. ..... 106/617
4,856,857 A * 8/1989 Takeuchi et al. ..... 359/3
4,880,652 A * 11/1989 Regutti ..... 426/417
5,154,956 A * 10/1992 Fradrich ..... 428/40.6
6,210,767 B1 * 4/2001 Knauf ..... 428/40.1
6,235,363 B1 * 5/2001 Bilodeau ..... 428/40.1
6,817,630 B1 * 11/2004 Fischer et al. ..... 283/67
7,201,953 B2 * 4/2007 Fischer et al. ..... 428/143

FOREIGN PATENT DOCUMENTS

DE 2 060 734 12/1969
DE 196 31 283 A1 8/1996
EP 0 348 349 6/1989

* cited by examiner

*Primary Examiner*—Willmon Fridie
(74) *Attorney, Agent, or Firm*—Berliner & Associates

(57) ABSTRACT

A method for the production of a multi-layer identity card of plastic. The card to be produced comprises at least one card core layer printed on at least one side and on the printed side of the card core layer, a covering layer is applied.

3 Claims, 2 Drawing Sheets

METHOD FOR THE PRODUCTION OF A MULTI-LAYER IDENTITY CARD OF PLASTIC

CROSS-REFERENCES TO RELATED APPLICATIONS

This application claims the benefit of U.S. patent application Ser. No. 09/600,452 filed Sep. 14, 2000, which claims the benefit of German Application No. 198 53 755.7 filed Nov. 21, 1998 and PCT/DE99/03640 filed Nov. 21, 1998, all of which are fully incorporated herein by reference.

STATEMENT OF FEDERALLY SPONSORED RESEARCH OR DEVELOPMENT

Not applicable.

BACKGROUND OF THE INVENTION

1. Field of the Invention

The present invention relates to a method for the production of a multi-layer identity card of plastic.

2. Description of the Related Art

The invention relates to a method for the production of a Multi-layer identity card of plastic. Such identity cards are widely employed as check or bank cards or as an authorization means for access to mobile radio communication systems. They comprise at least one card core layer, which is printed on at least one side and a covering layer applied to the printed the side of the card core layer. These card layers are joined together in a laminating process.

The covering layer, which is usually made transparent, has an adhesive coating thereon adhering to the printed card core layer, and serves inter alia for protecting the print and also as a means bearing additional information, which for instance is applied in the thermotransfer printing method.

For the card layers—both the card core layers and also the covering layers—various different materials come into question: for instance polyvinyl chloride (PVC), polycarbonate (PC), acrylonitrile-butadiene-styrene (ABS), polyethylene terephthalate (PET, PETG and PETF). The selection of the materials and accordingly of the card structure is dependent on different factors. These factors are for instance: the desired mechanical properties of the identity card to be manufactured, its behavior at high and low temperatures, the question of printability, the question of laser inscription and furthermore economic and ecological determinants.

Dependent on which card structure is selected, different laminating parameters (temperature, pressure and time) are predicative. Same are dependent more especially on which material is utilized for the card core layers.

It is known to apply an adhesive coating (adhesive promoter, adhesive primer) on the card core layer prior to printing, which is to ensure improved adhesion of the printing ink, i. e. printing takes place on an adhesive coated card core layer and not directly on the card core layer. This procedure—printing on an adhesive coated card core layer—is more particularly necessary in the case of so-called digital printing on plastic foils. In the case of digital printing the printing image to be applied to the plastic foil to be printed is temporarily held, that is to say with the aid of selective electrostatic charges, on the printing roller. This digital printing method, which is for example employed in lasers printers, has now only been employed for a short time so far for printing plastic foils for the manufacture of identity cards. The printing inks and printing parameters applicable here are different to those in printing methods (offset litho and screen printing) employed so far in a classical manner, in the range in question, the necessity of printing on an adhesive coated card core layer being the reason.

In the case of lamination of a multi-layer identity card formed in this fashion there is the following problem in the case of relatively high lamination temperatures (over 124° C.): above a certain lamination temperature there is an undesired displacement (shift or drift) of the adhesive coatings including the printed layer sandwiched between them in relation to the covering layer and the card core layer. Adhesive coatings customarily employed form a sort of lubricating film between the card core layer and the covering layer. This phenomenon is to be attributed to the rheological properties of the materials utilized.

BRIEF SUMMARY OF THE INVENTION

One object of the invention is to manufacture a multi-layer identity card of the type initially mentioned in such a manner that the above mentioned displacement does not take place.

In accordance with the invention adhesive coatings are employed, which contain at least one additive, which increases friction between the covering layer and the card core layer so that the formation of a lubricant film is prevented. As additives silica (SiO2), silicates and calcium carbonate ($CaCO_3$) have proved to be particularly effective. The flow behavior of the adhesive coating may in this manner be favorable influenced during further use under pressure and as a raised temperature in lamination.

The adhesive coatings themselves are preferably in the form of a thermoplastic adhesive as for example on the basis of polyamides, polyesters, or polyurethanes or the copolymers thereof. In this respect in one embodiment only silica or only silicate or only calcium carbonate as an additive is mixed with the adhesive formulations. In an alternative embodiment there is a provision such that a mixture of two or more additives is incorporated in the adhesive formulations. The surfaces of the additives employed may furthermore be chemically modified so that for instance embedding of the additives in the material of the adhesive coating is improved. Thus for instance in the case of the use of silica ($SiO_2$) as an additive silica with different silane coatings is employed. The silica may be in the form of naturally occurring silica such as sand, quartz or quartzite or synthetic silica.

As a silicate talcum is preferably employed. As calcium carbonate naturally occurring calcium carbonates, such as chalk or limestone or synthetically precipitated calcium carbonates come into question.

The percentage by weight of the additives in the adhesive coating amounts to at least 0.1% and at the most 60%.

The additives employed possess a comparatively large surface area related to their weight. The mobility of the chain molecules of the adhesive coating is reduced by the additives. Furthermore, there is an addition of polymer segments of the adhesive coating on the surface of the additives so that furthermore adjacent polymer segments of the adhesive coating are limited in their mobility. All in all it is possible to say that owing to the presence of the additives the rheology of the adhesive coating is so altered as regards the lamination parameters that the viscosity of the adhesive coating is increased so that it is favorable as regards the present application.

DETAILED DESCRIPTION OF THE INVENTION

Figure 1:
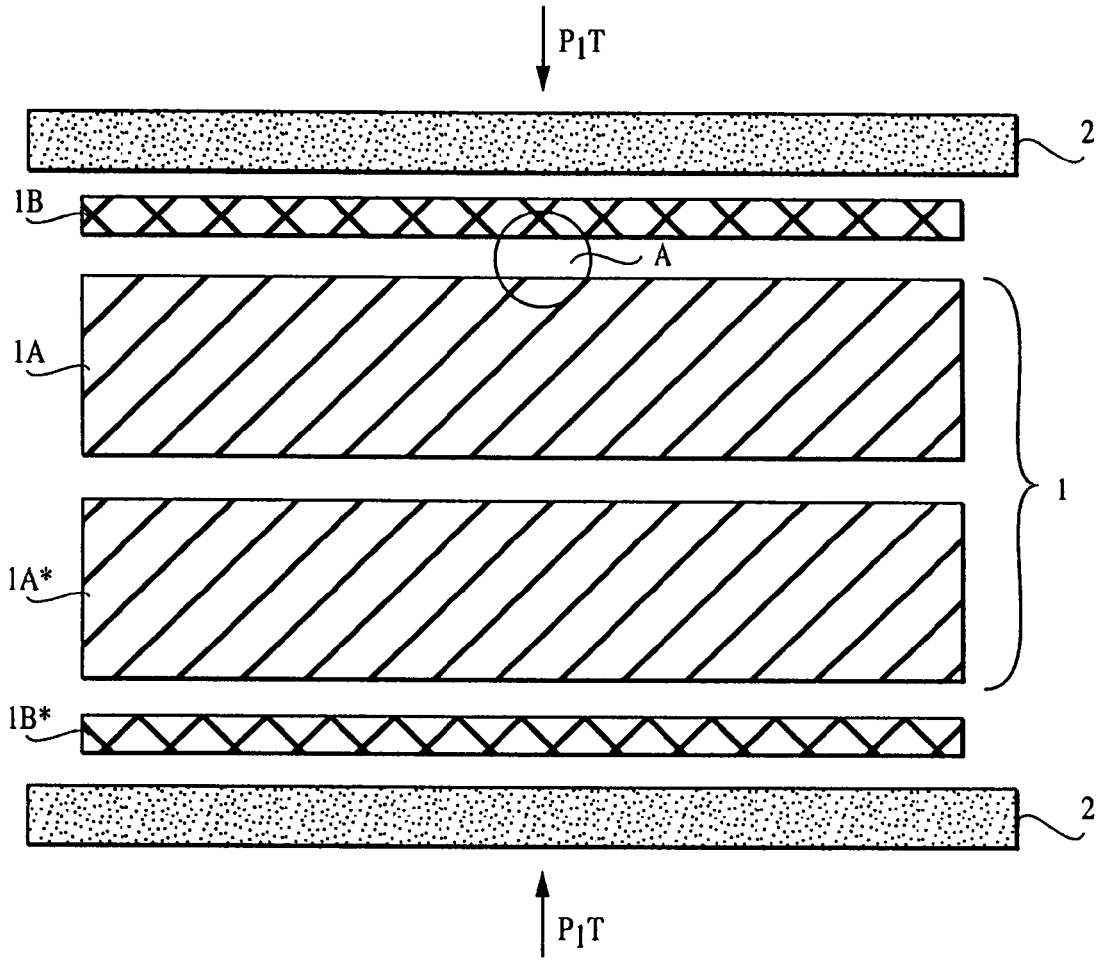
FIG. 1 illustrates the card layers to be laminated in an exploded view between the lamination platens of a laminating press.

In FIG. 1 the card layers, shown at a distance apart from each other, will be seen between the platens 2 of a laminating press. The card structure comprises two card core layers 1A and 1A*, which are respectively printed on one side, and two adhesive coated covering layers 1B and 1B*, which have the printed card core 1 between them in a sandwich array. The interface (between the covering layer and the card core layer) which is critical for the problem with which the invention is concerned is this case therefore present twice over. For the manufacture of the card body laminated in accordance with the invention it is preferred to employ the so-called multiple impression system—as distinguished from individual card production—so that the output rate is much greater than with individual card production. In the case of multiple impression manufacture for each card layer use is made of multiple impression sheets (printed card core sheets end adhesive coated covering layer sheets) each having a plurality of individual elements for the production of a plurality of laminated card core bodies. For this purpose the printed card core layer sheets possess a plurality of identical printed images. After lamination the individual card bodies are produced by being stamped out of the sheet. Both in individual card manufacture and also in multiple impression manufacture the layers or, respectively, sheets must be laid in register on top of each other before lamination. For the novel method it is a matter of indifference whether production is performed using the individual card method or the multiple impression method.

Figure 2:
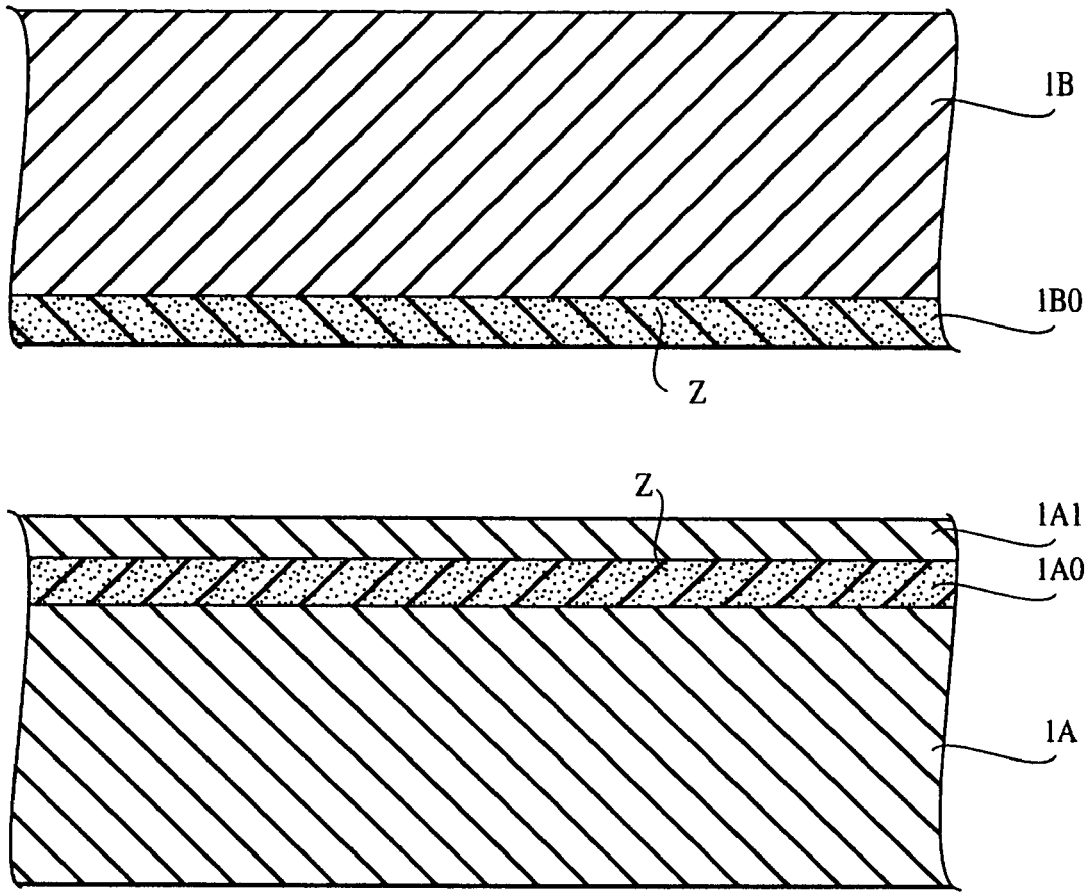
FIG. 2 illustrates, on a larger scale, a part with the covering layer and the card core layer.

In FIG. 2 the section A of FIG. 1 will be seen on a larger scale. The reader will see the adhesive coating 1B0 on the covering layer 1B, the adhesive coating 1A0 and also the printing ink layer 1AI on the card core layer 1A. The additives Z are present in the adhesive coating layers 1B0 and 1A0 to prevent a lubricating film being formed during lamination between the covering layers 1B0 and the card core layer 1A.

The thickness of the ink layer 1A1 is for example between 2 μm and 4 μm. The thickness of the covering layer 1B—without an adhesive coating 1B0—will amount, for example, to between 40 μm and 50 μm. The thickness of the adhesive coating 1B0 on the covering layer 1B will preferably amount to between approximately 0.1 and 20 μm. The thickness of the adhesive coating 1A0 on the card core layer 1A will preferably amount to approximately 0.1 and 10 μm. The thickness of the adhesive card core layer 1A itself amounts to approximately 300 μm.

The course of the method for the production of the multilayer identity card is as follows: In a first step the unprinted card core layer 1A is prepared. Then in a second step the adhesive coating 1A0 with the additives Z is applied all over the area of the card core layer 1A. In this case the adhesive coating 1A0 is preferably distributed in a liquid form by means of rollers evenly to the card core layer 1A. After drying and curing of the adhesive coating 1A then in a third step printing of such adhesive coated card core layer 1A takes place using digital printing. Following this in a fourth step the covering layer 1B is prepared, on which as well an adhesive coaling 1B0 with additives Z is located. In this case for the production of such adhesive coated covering layer 1B the adhesive coating 1B0 is preferably applied in a liquid form by means of rollers evenly on the covering layer 1B and then dried and caused to cure. In fifth step the card layers 1B, 1A 1B* and 1A* are placed in register on top of one another and finally, in the last step, placed in a laminating press, where they are connected together under pressure and under the action of heat.

Instead of using an adhesive coated covering it is possible to also apply only an adhesive coating with additives Z in a separate step on the printed card core layer and then on it a covering without any adhesive coating to be applied. In this case as well the application of the adhesive coating is preferably in a liquid form (for example in the form of a solvent containing adhesive formulation or as an aqueous dispersion) using rollers on the printed card core layer.

The invention claimed is:

1. A multiple layer identity card of plastic formed by a method comprising:

applying at least one card core layer (1A) having at least one adhesive coating (1A0) on one side and on which a printed layer (1A1) is located, applying a further adhesive coating (1B0) between the printed layer (1A1) and a covering layer (1B), and bonding the card core layer (1A), printed layer (1A1), and covering layer (1B) by the adhesive coatings (1A0 and 1B0) under the action of pressure and sufficient heat to laminate the assembly, characterized in that the adhesive coatings (1A0 and 1B0) comprise at least one additive (Z) in solid, insoluble form in the coating selected from the group consisting of silica ($SiO_2$), a friction causing silicate, and calcium carbonate ($CaCO_3$), such as to cause friction between the covering layer (1B) and the printed card core (1A) during lamination.

2. The multiple layer identity card of claim 1, wherein the friction causing silicate is talcum.

3. A multiple layer identity card of plastic formed by a method comprising:

applying at least one card core layer (1A) having at least one adhesive coating (1A0) on one side and on which a printed layer (1A1) is located, applying a further adhesive coating (1B0) between the printed layer (1A1) and a covering layer (1B), and bonding the card core layer (1A), printed layer (1A1), and covering layer (1B) by the adhesive coatings (1A0 and 1B0) under the action of pressure and sufficient heat to laminate the assembly, characterized in that the adhesive coatings (1A0 and 1B0) comprise at least one additive (Z) selected from the group consisting of silica ($SiO_2$), and calcium carbonate ($CaCO_3$), which increases the friction between the covering layer (1B) and the printed card core (1A) during lamination and which is embedded in the adhesive coatings (1A0 and 1B0).

* * * * *